United States Patent [19]

Lee et al.

[11] Patent Number: 5,018,315

[45] Date of Patent: May 28, 1991

[54] APPARATUS FOR HOLDING AND STORING SHARPENING STONES

[75] Inventors: Leonard G. Lee, Ottawa; Francis A. McLean, Kemptville; Jean H. Gagnon, Aylmer, all of Canada

[73] Assignee: Lee Valley Tools Ltd., Ottawa, Canada

[21] Appl. No.: 577,864

[22] Filed: Sep. 5, 1990

[51] Int. Cl.[5] ..... B24B 3/00; B24B 53/02; B28D 1/00

[52] U.S. Cl. ..... 51/213; 51/211 R; 51/5 D; 51/158; 125/2

[58] Field of Search ..... 51/211 R, 5 D, 211 H, 51/181 R, 212, 267, 213, 158; 129/2, 6

[56] References Cited

U.S. PATENT DOCUMENTS

| | | | |
|---|---|---|---|
| 955,265 | 4/1910 | Hayne | 51/211 R |
| 977,838 | 12/1910 | Powell | 51/213 |
| 2,191,719 | 2/1990 | Kuhlman | 51/213 |
| 2,453,207 | 11/1948 | Dunn | 51/211 R |
| 3,681,806 | 8/1972 | Hao | 51/181 R X |
| 3,721,049 | 3/1973 | Nakaham | 51/211 R |
| 4,904,280 | 2/1990 | Cygan et al. | 51/296 |

OTHER PUBLICATIONS

Woodcraft 1990–91 Catalog, p. 99.

*Primary Examiner*—Frederick R. Schmidt
*Assistant Examiner*—Bruce P. Watson
*Attorney, Agent, or Firm*—Kilpatrick & Cody

[57] ABSTRACT

Apparatus for holding and storing sharpening stones that includes a water-tight reservoir which is open at the top and contains an integral supporting lip, bars that span the open top of the reservoir and are received within recesses in the reservoir sides, clamps on the rod to securely hold a sharpening stone in place, a lapping plate that rests within the integral supporting lip of the reservoir, and a dust cover which fits securely over the open top of the reservoir.

7 Claims, 2 Drawing Sheets

APPARATUS FOR HOLDING AND STORING SHARPENING STONES

BACKGROUND OF THE INVENTION

Woodworkers have long used man-made and natural stones for sharpening or honing woodworking and other tools. Natural stones such as Arkansas stone and man-made stones, often referred to as India stones, typically have been used in the western hemisphere in combination with oil. The oil lubricates the stone and holds the abraded particles of the stone in suspension, both of which aid in the sharpening process.

Although the oil is usually applied to the surface of the stone just prior to use, an apparatus for holding three oil stones simultaneously has been available for some time. This apparatus mounts three oil stones on a rotatable spindle suspended above a reservoir of oil. Rotating the spindle simultaneously submerses two stones in the oil while the third stone is held in position for use. However, the apparatus will allow use of only one oil stone at a time, requiring the woodworker to frequently rotate the spindle to expose the proper oil stone and will not permit simultaneous contact of all three stones with the oil.

More recently, stones of a type widely used in Japan that use water as a lubricant have become popular in the West. These water stones, most of which are man-made, are softer than oil stones, wear more quickly, and require relatively frequent trueing or lapping to remain flat. The abraded particles of such water stones, however, form a cutting slurry which makes it possible to sharpen a tool more quickly than by using a comparable oil stone. This advantage has resulted in the increasing popularity of water stones.

All but the finest grit of such water stones are used by soaking the stones in water prior to use so that they absorb water into their relatively porous structure. This absorbed water then migrates to the stone's surface when the stone is removed from the water during use. In addition to the need to soak these stones in water, they also must be held firmly in place while in use. Some manufacturers have mounted their stones on wood bases in order to help hold them securely during use. However, these wood bases tend to degrade from their constant exposure to water, and even when such bases remain sound, there modest size and mass provide a relatively unstable support for the stone.

North American woodworkers have enthusiastically embraced the use of "Japanese" water stones, typically adding a water-filled plastic dish pan or bucket in which to store such stones to their already cluttered workshops. Woodworkers have found the use of water stones, however, to be messy, typically resulting in water being dripped across the workbench when the stones are removed from the dish pan or bucket and positioned for use. Furthermore, unsatisfactory and often unstable mounting schemes for the stones during use are frequently made to substitute for a more satisfactory arrangement.

These problems have apparently never impeded the practice of woodworking in the Japanese tradition, where the prevailing aesthetic calls for a minimum number of very basic (albeit highly-refined) tools, and much of the work is done on the floor. However, more gadget-enthralled western woodworkers have suffered for their conversion to water stones, often splattering their workbenches with dirty water at tool sharpening time or maintaining a muddy mess in the workshop corner where the stones are stored and used.

Furthermore, because sharpening stones are generally kept in the workshop, which is typically a dusty environment, it is generally desirable to place a cover or lid over the storage means in order to keep debris out, and prevent evaporation of the storage water. The typical solution to this problem has been to fashion a lid of wood or cardboard and place it over the dish pan or bucket.

Accordingly, one objective of the present invention is to provide a device that stores sharpening stones immersed in water and that will also securely and neatly hold the sharpening stones out of the water during use.

Another objective of the present invention is to provide a device that stores sharpening stones immersed in water and suspended above any sludge that may accumulate in the bottom of the storage container.

A further objective of the present invention is to provide a lid or cover to prevent contamination and evaporation of the water within the storage container.

Another objective is the provision of a readily accessible, true lapping surface for use in flattening worn stones.

A further objective of the present invention is to provide a true lapping surface with a readily replaceable abrasive material so as to maintain the lapping surface in a true and flat condition.

These and other objectives of the present invention will become apparent from the detailed description and claims which follow.

DETAILED DESCRIPTION OF THE DRAWINGS

Figure 1:
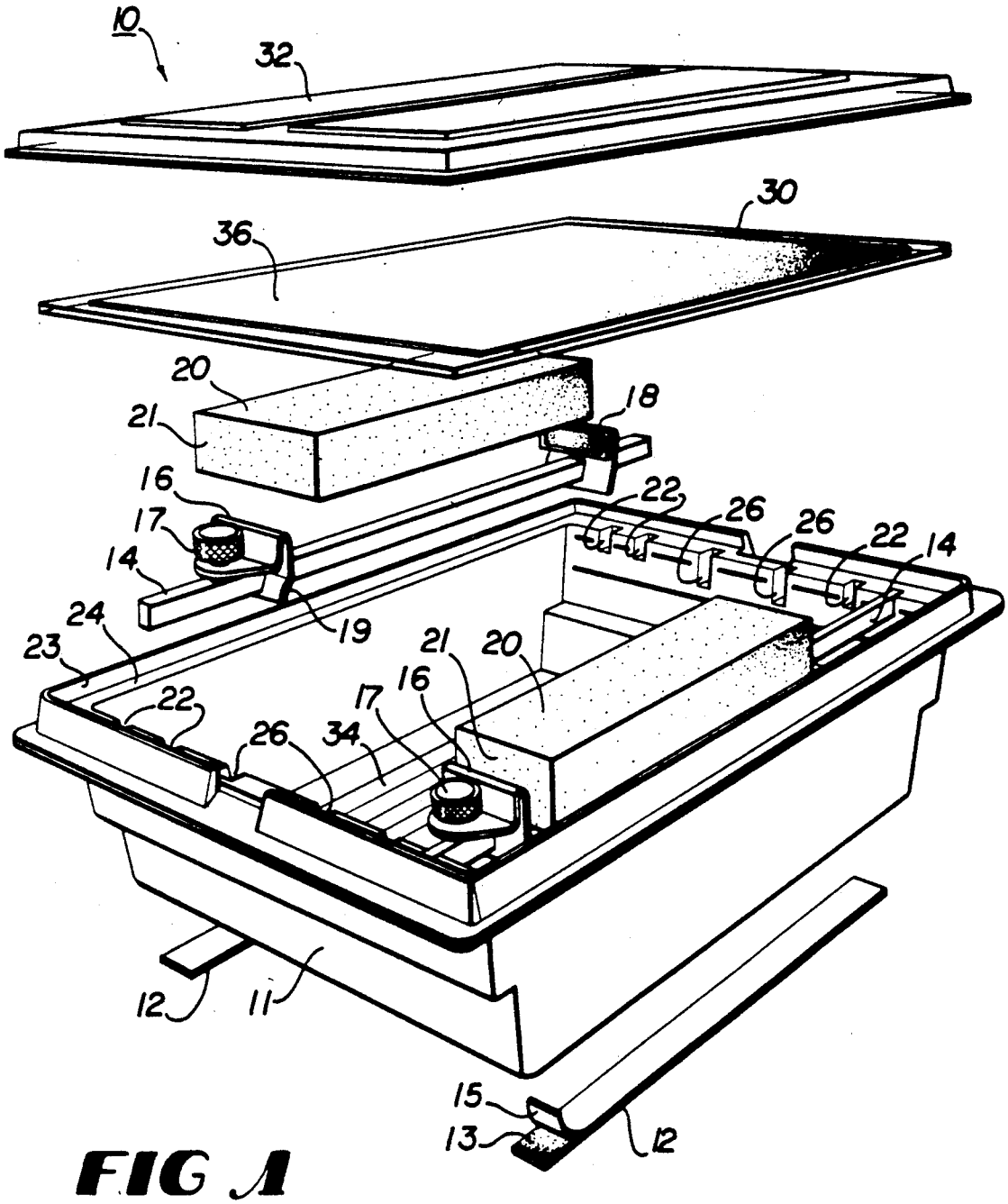
FIG. 1 is an exploded view perspective of the water stone storage and clamping assembly of the present invention.
Figure 2:
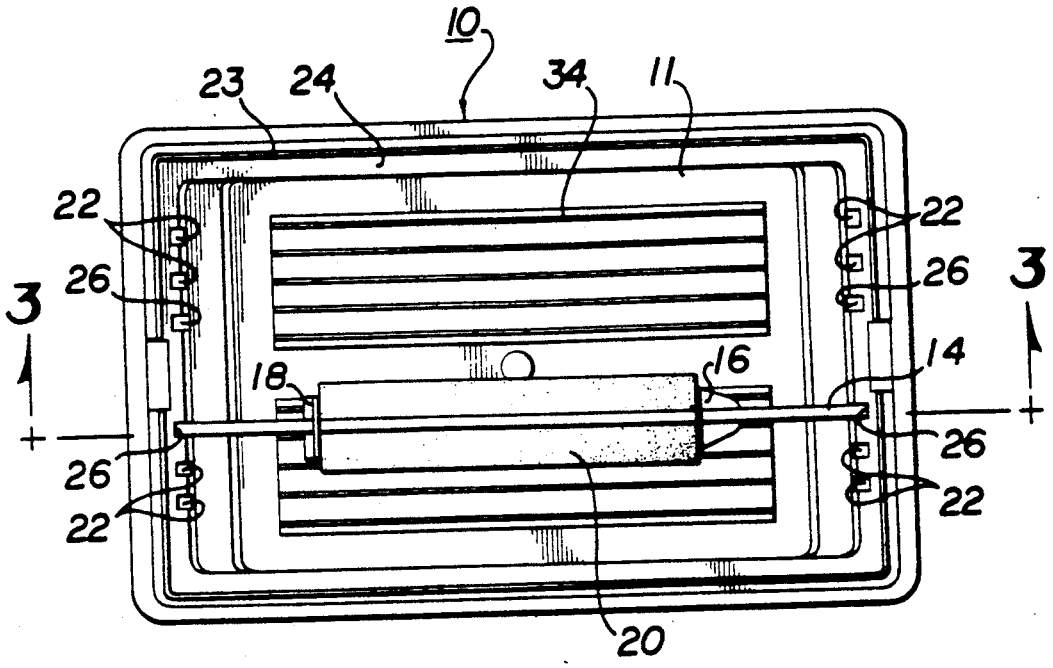
FIG. 2 is a plan view of the assembly shown in FIG. 1.
Figure 3:
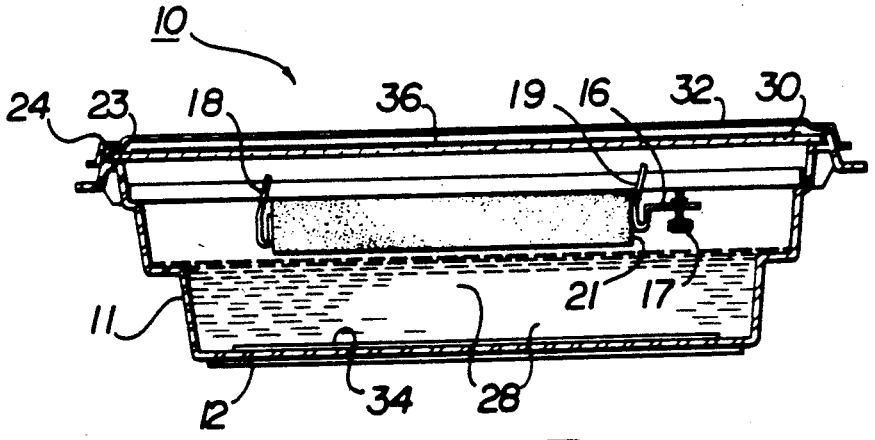
FIG. 3 is a cross-sectional view of the assembly of the present invention taken through Line 3—3 on FIG. 2.

FIG. 1 illustrates the sharpening stone storage and mounting assembly 10 of the present invention in an exploded perspective view. A reservoir 11 can be made of any rigid, water-tight material, although acrylonitrile butadiene styrene or polyvinyl chloride are among more suitable materials. Nonslip strips 12, such as rubber or cork, are attached to the bottom of reservoir 11 by pressure-sensitive adhesive 13, covered prior to affixation by protective strips 15. Such strips 12 prevent reservoir 11 from slipping during use. Fixtures for holding each sharpening stone 20 are provided by an assembly including a bar 14, clamping jaw 16 which is fixed by thumbscrew 17, and tail jaw 18. Bar 14 has a rectangular cross-section and is substantially the same length as reservoir 11. Clamping jaw 16 and tail jaw 18 contain rectangular holes of substantially the same size and shape as bar 14 so that bar 14 slides through the holes in clamping jaw 16 and tail jaw 18 and permits clamping jaw 16 and tail jaw 18 to be received on and lockably positioned along bar 14. Thumbscrew 17 is received by a smaller, threaded hole in clamping jaw 16 and when tightened, presses against bar 14, thereby locking clamping jaw 16 in a fixed position and tilting surface 19 of clamping jaw 16 against the end 21 of stone 20 so that stone 20 can be clasped between the jaws 16 and 18. Bar 14, clamping jaw 16, and tail jaw 18 should be made of a rust-resistant material such as aluminum or stainless steel, and thumbscrew 17 likewise may be made of brass. The ends of bar 14 fit into notches 22 formed into the sides of reservoir 11 so that when the sharpening stone 20 is clamped by the clamping jaw 16 and the tail jaw 18, one edge of the sharpening stone 20 rests in a recess 24 formed into the upper rim of reservoir 11, thereby supporting and securely holding the sharpening stone 20 during use. Deeper notches 26 also formed in the sides of reservoir 11 allow the fixtures to be inverted and suspended below lapping surface 30 or cover 32 during storage, as illustrated in FIG. 2 and FIG. 3. Ridges 34 formed in the bottom of reservoir 11, allow the sharpening stone 20 to be placed on the bottom of reservoir 11, in contact with water 28 but held above any sludge that may have collected in the bottom of reservoir 11. A flat lapping surface 30, such as glass, receives either an abrasive bearing sheet 36 attached with suitable adhesive, or a thin non-abrasive sheet 36 attached with suitable adhesive to which a lapping compound may be applied, nests within the recess 24 defined by upstanding rim on lip 23 acting as a cover during storage and is used to resurface and true worn sharpening stones 20. In addition, a cover 32 can be used that fits over the upper rim or lip 23 of reservoir 11, keeping out dust and other debris and reducing the rate of evaporation of water when the device is not in use.

We claim:

1. An apparatus for holding and storing sharpening stones comprising:

(A) a plurality of sharpening stone holding fixtures, each fixture comprising a bar and two spring clips positionable on the bar so as to clasp a stone therebetween;

(B) a fluid reservoir having (1) a bottom containing raised ridges and (2) sides attached to the bottom to form a container for fluid, the upper margins of the sides forming an upper peripheral edge that includes (i) an upstanding lip defining a recess and (ii) a means for receiving the fixtures in a first position comprising a plurality of pairs of notches substantially equal in depth to the thickness of the bar so that the top of the bar is substantially coplanar with the upper peripheral edge of the reservoir and (iii) a means for receiving the fixture in a second position comprising a plurality of pair of notches greater in depth than the thickness of the bar so that the top of the bar is lower than the upper peripheral edge of the reservoir; and (C) a sheet of glass to be received in the recess to cover the container and provide a surface for lapping stones.

2. The apparatus of claim 1 wherein the fluid reservoir comprises polyvinyl chloride.

3. The apparatus of claim 1 further comprising slip resistant strips attached to the bottom the fluid reservoir.

4. The apparatus of claim 1 further comprising a dust cover positionable to overlie the lip.

5. The apparatus of claim 1 wherein the sheet of glass has a removable abrasive bearing sheet.

6. The apparatus of claim 1 wherein the sheet of glass has a removable nonabrasive sheet to which lapping compound may be applied.

7. An apparatus for holding and storing sharpening stones comprising:

(A) a plurality of sharpening stone holding fixtures, each fixture comprising a bar and a means for securing a sharpening stone on the bar; and (B) a fluid reservoir having (1) a bottom and (2) sides attached to the bottom to form a container for fluid, the upper margins of the sides forming an upper peripheral edge having (i) a means for receiving the fixtures in a first position comprising a plurality of pairs of notches substantially equal in depth to the thickness of the bar so that the top of the bar is substantially coplanar with the upper peripheral edge of the reservoir and (ii) a means for receiving the fixture in a second position comprising a plurality of pairs of notches greater in depth than the thickness of the bar so that the top of the bar is lower than the upper peripheral edge of the reservoir.

* * * * *